US008667890B2

(12) United States Patent
Macchi

(10) Patent No.: US 8,667,890 B2
(45) Date of Patent: Mar. 11, 2014

(54) CARTRIDGE FOR COFFEE AND SOLUBLE PRODUCTS FOR PREPARING BEVERAGES

(75) Inventor: Edoardo Macchi, Ossona (IT)

(73) Assignee: Mitaca S.r.l., Frazione Malvaglio (Milano) (IT)

( * ) Notice: Subject to any disclaimer, the term of this patent is extended or adjusted under 35 U.S.C. 154(b) by 262 days.

(21) Appl. No.: 13/263,466

(22) PCT Filed: Apr. 8, 2010

(86) PCT No.: PCT/EP2010/054674

§ 371 (c)(1), (2), (4) Date: Oct. 7, 2011

(87) PCT Pub. No.: WO2010/115970

PCT Pub. Date: Oct. 14, 2010

(65) Prior Publication Data

US 2012/0031280 A1 Feb. 9, 2012

(30) Foreign Application Priority Data

Apr. 9, 2009 (IT) ..... MI2009A0571

(51) Int. Cl.
*A47J 31/00* (2006.01)
*B65B 29/02* (2006.01)

(52) U.S. Cl.
USPC ..... 99/295; 99/323; 206/5; 426/77; 426/82

(58) Field of Classification Search
USPC ..... 99/295, 323, 302 R; 426/77, 82, 84, 426/112, 115
See application file for complete search history.

(56) References Cited

U.S. PATENT DOCUMENTS 5,948,455 A 9/1999 Schaeffer et al.

FOREIGN PATENT DOCUMENTS

| | | | |
|---|---|---|---|
| EP | 0 521 510 | A1 | 1/1993 |
| EP | 0 806 373 | A1 | 11/1997 |
| EP | 1 555 218 | A1 | 7/2005 |
| EP | 1 835 210 | A1 | 9/2007 |
| WO | 2008/017608 | A1 | 2/2008 |

OTHER PUBLICATIONS

International Search Report, dated Aug. 20, 2010, from corresponding PCT application.

*Primary Examiner* — Reginald L Alexander
(74) *Attorney, Agent, or Firm* — Young & Thompson

(57) ABSTRACT

A cartridge (1) for coffee or soluble products for producing a beverage, includes a container (2) able to contain the coffee or soluble product, a lid (6) disposed over the container so as to define a top wall for entry into the container (2) of the hot water under pressure for formation of the beverage, a filter (4) suitable for being positioned inside the container (2) above a bottom wall (20) of the container through which the beverage exits, wherein the bottom wall (20) of the container has a less thick central area (22), at the center of which are disposed thickening ribs (27) along the edge of which there are etchings (26) able to break when the liquid inside the cartridge reaches a pre-set pressure value, so as to form flexible tongues (28) which give rise to apertures (50) through which the beverage is delivered.

11 Claims, 3 Drawing Sheets

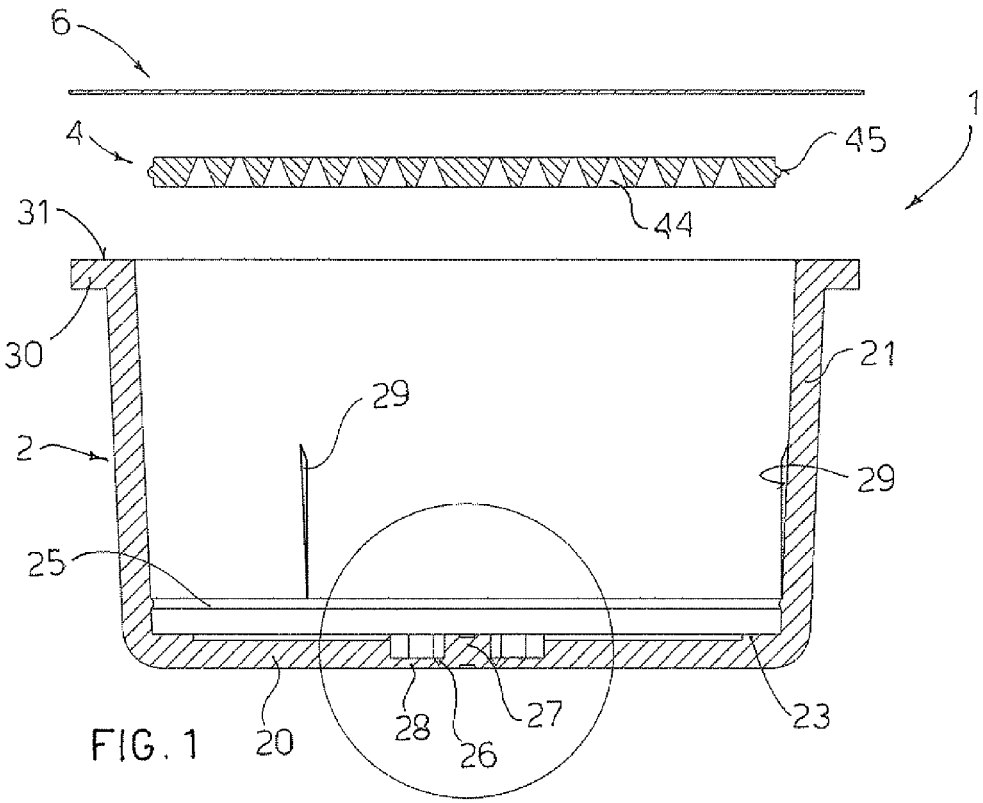
FIG. 1
FIG. 2
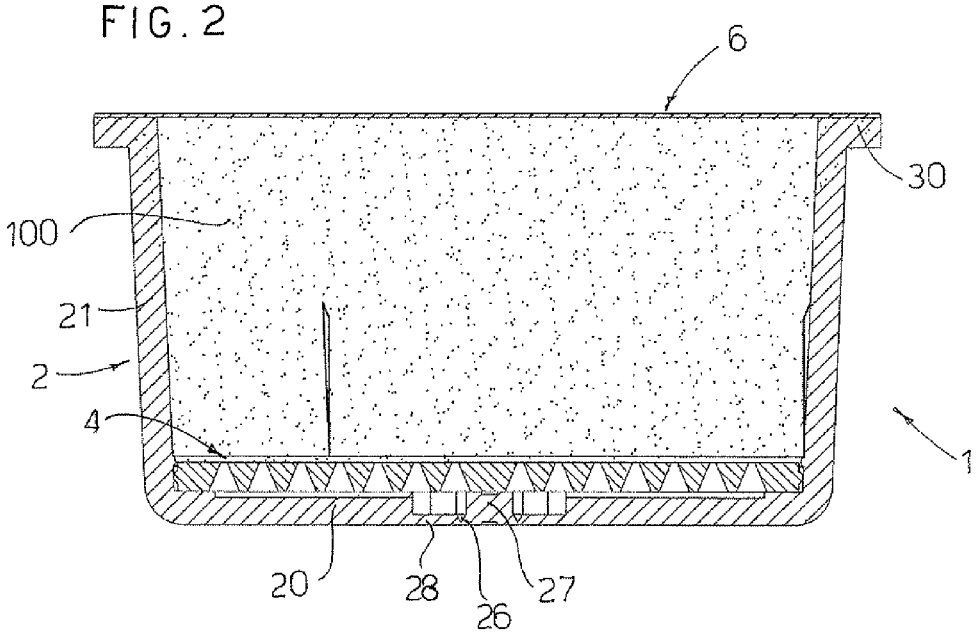

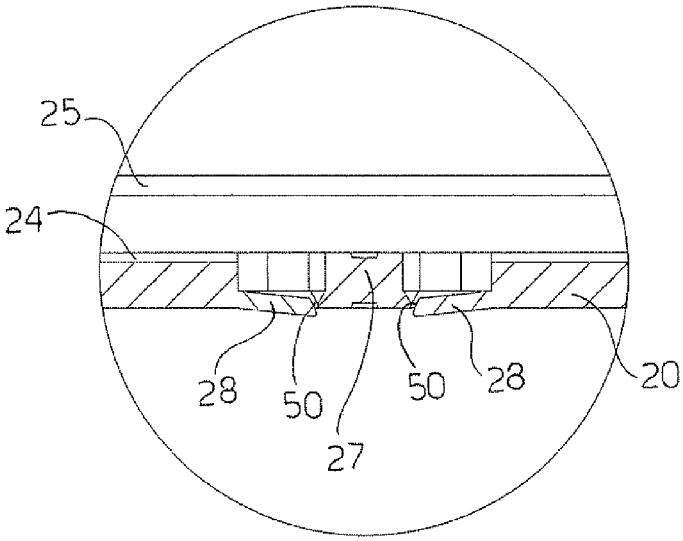
FIG. 3
FIG. 7
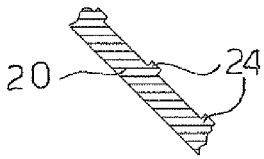
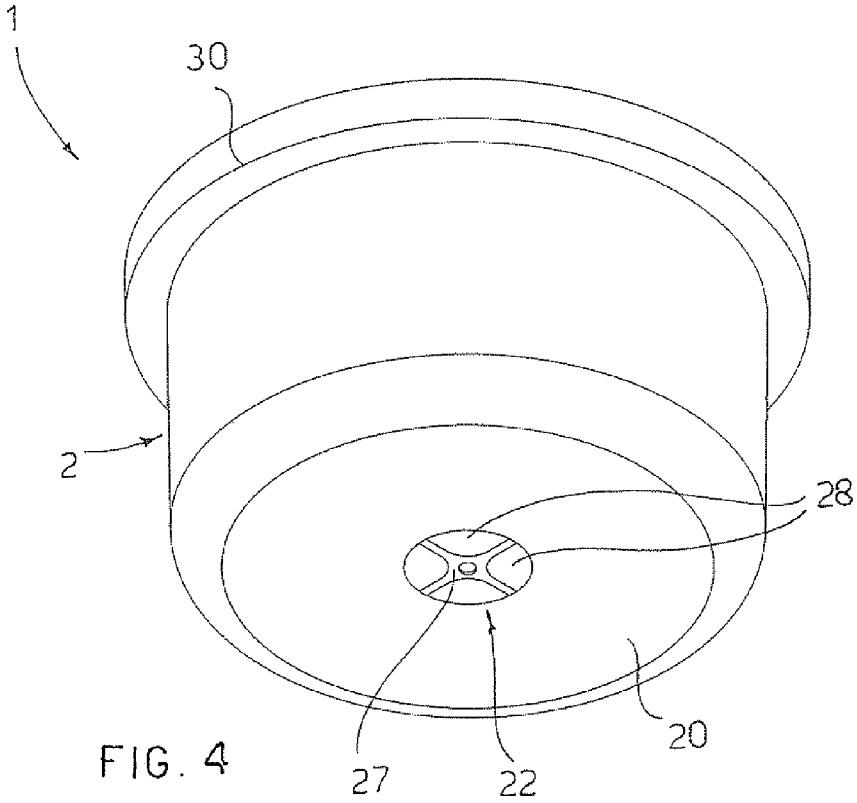
FIG. 4

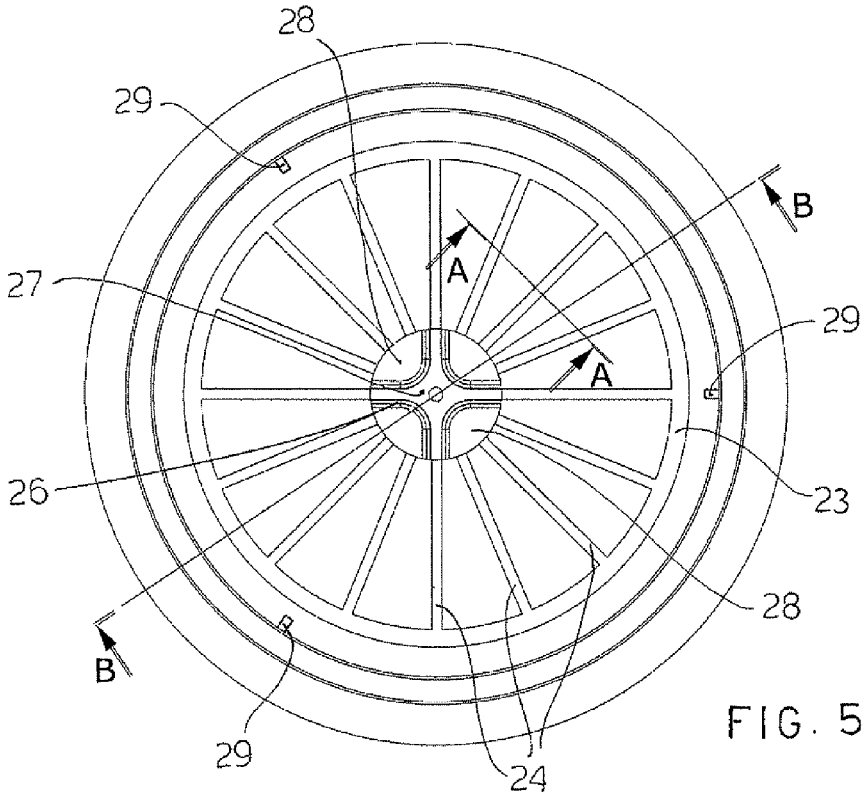
FIG. 5
FIG. 6
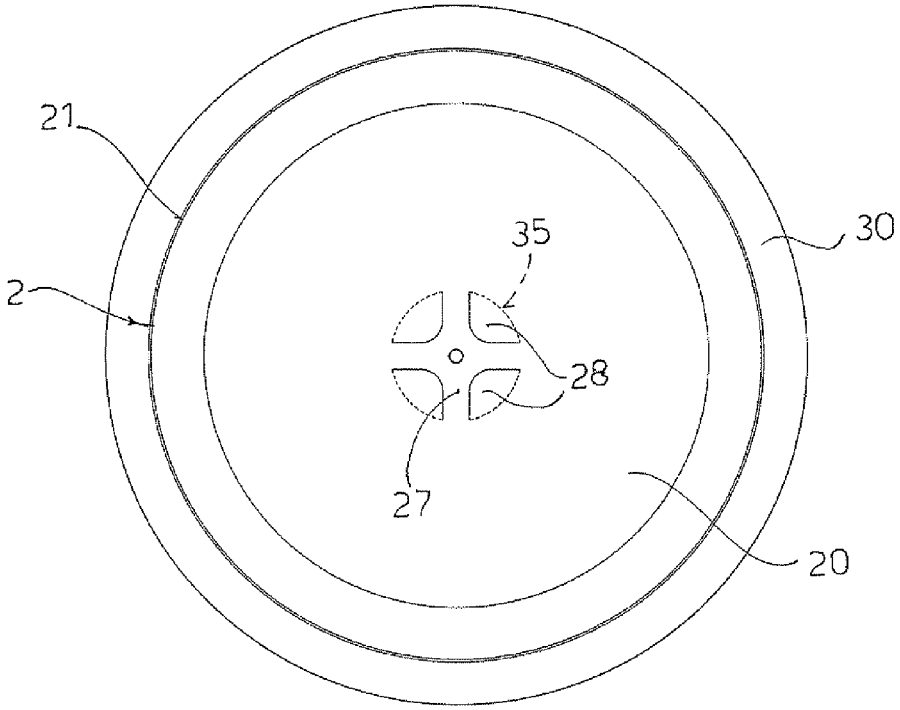

CARTRIDGE FOR COFFEE AND SOLUBLE PRODUCTS FOR PREPARING BEVERAGES

The present invention refers to a cartridge or capsule for containing coffee or soluble products in general, such as for example barley, powdered milk, tea, camomile, herb teas and the like, for preparing the respective beverages.

In the rest of this description, it being understood that the cartridge according to the invention can be used for the preparation of the various beverages mentioned above, specific reference will be made to coffee, the product for which the cartridge according to the invention has been particularly designed.

Essentially two types of cartridge for containing coffee in powder or fine granules are widely available on the market: rigid cartridges and flexible cartridges.

The cartridge according to the invention is of the rigid type, so reference will be made hereunder only to this type of cartridge of the prior art.

Rigid cartridges are substantially cylindrical in shape and comprise two half-shells of rigid plastic material, heat-sealed or hot-glued together, and enclose on their inside the coffee in powder placed on a filter in contact with the bottom wall of the cartridge.

Normally the bottom wall of the cartridge is perforated, whilst the top wall may or may not be perforated, depending upon the type of apparatus used for extraction of the beverage, that is one with a perforated top wall or with simple injection of hot water under pressure, which, passing through the powder product, enters the cartridge and captures its aromas, passing through the filter which retains the powder product, and flows out through the holes provided in the bottom wall, thus producing the beverage which is caught in an appropriate glass or cup beneath.

This type of rigid cartridge with a perforated bottom wall, on the one hand, holds the drawback that the product inside it is exposed to the outside environment and can thus lose its fragrance if it is not tightly closed in a further protective package, and on the other hand that during infusion it is not possible to reach adequate water pressures, which has repercussions on the quality of the beverage obtained.

In an attempt to overcome these drawbacks, the same Applicant I.TA.CA. S.r.l. has obtained European patent EP 1555218, the content of which is incorporated herein by reference.

According to what is described in EP 1555218, the bottom wall of the cartridge is completely closed and has a weakened central portion with pre-cuts arranged in cross, able to open on reaching a pre-set pressure, allowing the beverage to flow out.

The applicant has noted that such a cartridge, though providing a good beverage, is susceptible of improvement.

In particular, the cuts arranged in a cross on the bottom of the cartridge cause the bottom of the cartridge to be opened by knocking out, with a permanent central opening through which the beverage exits.

The applicant has noted that the continuous outflow of the beverage through the above mentioned central opening (see FIG. 5 of EP 1555218) gave rise to a poorly emulsified beverage.

The applicant has therefore carried out numerous studies aiming to improve the quality of the beverage that can be obtained with such a cartridge.

Object of the invention is precisely to improve the cartridge forming the subject matter of patent EP 1555218.

In particular an object of the invention is to provide such a cartridge for coffee that makes it possible to deliver a beverage that is more creamy and therefore of better quality than those thus far obtainable.

Another object of the invention is to provide such a cartridge for coffee that is simple and cheap to make and that can be used in various types of traditional beverage dispensing machines.

These objects are achieved according to the invention with the coffee cartridge having the features recited in the independent claim and as described in detail below.

Advantageous embodiments of the invention are apparent from the dependent claims.

SUMMARY OF THE INVENTION

Essentially, the cartridge according to the invention, of the type described in EP 1555218, has on the bottom wall a less thick, weakened central portion, centrally to which are formed rigid ribs along the edges of which etchings are made, defining a plurality of tongues.

The central ribs are advantageously arranged in a cross and define four flexible tongues, permanently attached at their base to the bottom of the cartridge.

The pressure of the water in the cartridge at the time of delivery of the beverage produces breakage of the aforesaid etchings at the vertices of the tongues and a vibrating effect thereon, which allows a creamy beverage to be obtained right from the start of delivery, with the cream persisting on the beverage for several minutes.

Coffee is in fact a food rich in essential oils and at the time of delivery of the beverage it creates an emulsion, that is, the cream of the coffee. Experimental tests carried out by the applicant have demonstrated that the cream that can be obtained with the cartridge according to the invention is qualitatively superior to that which can be obtained with cartridges of the prior art and in particular with the cartridge of patent EP 1555218.

BRIEF DESCRIPTION OF THE DRAWINGS

Further characteristics of the invention will be made clearer by the detailed description that follows, referring to a purely exemplifying and therefore non limiting embodiment thereof, illustrated in the appended drawings, wherein:

FIG. 1 is an exploded, axial sectional view, illustrating a cartridge for coffee according to the invention, the section being taken along the line B-B of FIG. 5;

FIG. 2 is a view like FIG. 1 showing the cartridge as assembled;

FIG. 3 is an enlargement of the detail enclosed in the circle C of FIG. 1, in the configuration it assumes during delivery of the beverage;

FIG. 4 is an axonometric bottom view of the cartridge according to the invention;

FIG. 5 is a top plan view of the container of the cartridge;

FIG. 6 is a bottom plan view of the container of FIG. 5;

FIG. 7 is a section taken along the line A-A of FIG. 5.

DETAILED DESCRIPTION OF THE PREFERRED EMBODIMENTS

With reference to said figures, the cartridge for coffee according to the invention has been indicated as a whole with reference numeral 1.

It comprises a frustoconical shaped container body 2 (but it is obvious that it can also be cylindrical in shape) open at the top and comprising a bottom or lower wall 20, substantially discoid shaped, from which is erected a side wall 21 with a slight upward taper.

On the bottom 20 of the container 2 is disposed a filter 4, as will be better described further on, and after the container has been filled with coffee 100 (FIG. 2) it is closed with a lid 6.

The bottom wall 20 has a central portion 22, circular in shape, which is less thick than the bottom wall 20. At the centre of said circular portion 22 there are stiffening ribs 27, arranged in a cross, defining in said less thick portion 22 four flexible tongues 28 which are flush with the inside surface of the bottom wall 20.

Along the outline of the ribs 27 arranged in a cross, there are provided etchings or grooves 26, such as to determine in said areas a further thinning of the material, so as to prove breakable in said areas.

The tongues 28 are substantially triangular in shape with rounded edges, that is, shaped like circular sectors defined by an angle of 90° at the centre, and are permanently attached to the bottom wall of the container at the edge 35 of said less thick portion 22, whilst they are breakable at the opposite vertex, where said etchings 26 are provided, following an increase in pressure inside the cartridge, as will be described better further on.

The bottom wall 20 further has a peripheral part 23 having a greater thickness, so as to generate an annular shaped thickening, in contact with the side wall 21 and protruding upwards from the inside surface of the bottom wall 20.

On the inside surface of the bottom wall 20, between the less thick or weakened central portion 22 and the peripheral portion of thickening 23, there are provided radially arranged ribs 24, having a thickness equal to that of the peripheral portion of thickening 23.

A plurality of thickening ribs 29 (three in the embodiment shown), perpendicular to the bottom wall 20 and reaching to about half the height of the container 2 are provided inside the side wall 21 of the container body 2.

The purpose of the thickenings 29 is to allow the containers to be stacked inside one another without restraining each other, by making the bottom 20 of a container abut against the free upper ends of said thickening ribs 29.

An annular projection or collar 25 serving as a stop for positioning of the filter 4 is also provided on the inner surface of the side wall 21, near the bottom 20 of the container 2.

The side wall 21 of the container also has an annular top edge 30 that protrudes outwards so as to give rise to a substantially flat top surface 31.

The container 2 is made in a single body, by injection moulding of rigid plastic material, such as, for example, plastic for food use and in particular polypropylene and other plastic materials. The bottom wall 20 and the side wall 21 of the container 2 have no perforation and have thicknesses designed to ensure that the container 2 has a certain stiffness so as to be able to withstand high pressures even for a relatively long time.

The filter 4 is substantially discoid shaped and has on its peripheral edge a collar 45, able to be positioned beneath the collar 25 formed on the inner surface of the side wall 21 of the container, when the filter is disposed therein, resting on the ribs 24 and on the peripheral thickening 23 of the bottom wall 20, so that the filter 4 does not obstruct the central portion 22 of the bottom wall of the container and the beverage can circulate freely among the radial ribs 24 during delivery.

The filter 4 thus positioned, as shown in FIG. 2, is preferably heat bonded to the side wall 2 of the container, at said collars.

The filter 4 has on its discoid shaped surface a plurality of conical or truncated pyramid shaped holes 44, suitable for allowing the passage of the beverage from top to bottom and retaining the granular or powdery product above the filter inside the cartridge 1.

When the filter 4 has been positioned on the bottom wall 20 of the container 2, this is filled with coffee 100 or another soluble product and the container is closed with the lid 6 which is fixed to the upper surface 31 of the annular rim 30 by means of heat bonding, ultrasonic bonding, gluing or the like.

The lid 6 can have micro perforations suitable to allow the passage of water and/or steam under pressure. For this purpose the lid 6 may be made from one or more layers of filter paper or one or more strips of micro perforated plastic material.

Alternatively, the lid 6 may have a completely airtight closure, if the beverage extraction apparatus provides means of perforating the lid.

For delivery of the beverage, the cartridge 1 according to the invention is disposed in a special per se known extracting apparatus such as the one described in the above mentioned patent EP 1555218.

Hot water under pressure is introduced through the lid 6 into the cartridge 1, coming into contact with the coffee 100.

When the pressure of the water inside the cartridge reaches a pre-set level, the flexible tongues 28 yield along the etchings 27, and in particular at their vertex in the centre, forming outlet apertures 50 for the beverage, which flows in a special conduit of the apparatus (not shown) and is collected in a glass or cup beneath.

During delivery of the coffee the flexible tongues 28 begin to vibrate, continually widening and narrowing the outlet apertures 50, thus producing a highly emulsifying effect on the beverage flowing out, with the formation of a dense, long-lasting cream.

The applicant has been able to verify that such a result cannot be achieved with the cartridges previously used.

Naturally, the invention is not limited to the particular embodiment previously described and illustrated in the appended drawings, but it is possible to make thereto numerous modifications of detail within the reach of a person skilled in the art, without thereby departing from the scope of the invention as set forth in the appended claims.

The invention claimed is:

1. A cartridge for coffee or soluble products for the production of a beverage, comprising:

a container (2) designed to contain coffee or soluble product;

a lid (6) arranged on the container (2) so as to define an upper wall through which hot water under pressure enters the container in order to produce the beverage;

a filter (4) designed to be positioned inside the container (2) above a bottom wall (20) of the container through which the beverage leaks;

said bottom wall (20) of the container having at least one breakable portion designed to break when the liquid inside the cartridge reaches a pre-set pressure, so as to form at least one aperture (50) to allow the beverage to be extracted from the cartridge (1), characterized in that said at least one breakable portion is obtained by means of a pre-etching or groove (26) delimiting a less thick portion (22) of the bottom wall (20) of the container (2) from stiffening central ribs (27), so as to form at least one flexible tongue (28), which is attached to said bottom wall (20) along an edge (35) and can be separated from said central ribs (27) to determine said aperture (50) for the beverage leakage.

2. A cartridge (1) according to claim 1, characterized in that said rigid stiffening ribs (27) are arranged in a cross shape at the centre of said less thick portion (22) of the bottom wall (20) of the container (2), so as to determine four flexible tongues (28) arranged between adjacent arms of said cross.

3. A cartridge (1) according to claim 1, characterized in that said less thick portion (22) is substantially circular in shape.

4. A cartridge (1) according to claim 3, characterized in that said flexible tongues (28) are circular sector in shape with a rounded vertex, said aperture (50) being formed at said vertex or angle at the centre of the circular sector.

5. A cartridge (1) according to claim 1, characterized in that radially arranged ribs (24) are provided inside said bottom wall (20), designed to support said filter (4) so as to define a space between the bottom wall (20) and the filter (4) to flow the filtered beverage out.

6. A cartridge (1) according to claim 1, characterized in that said container (2) is frustoconical, cylindrical in shape or the like.

7. A cartridge (1) according to claim 6, characterized in that thickenings (29) are provided inside the side wall (21) of the container (2), designed to avoid that stacked containers restrain each other, acting as a stop for the bottom wall (20) of an overhanging container (2).

8. A cartridge (1) according to claim 1, characterized in that said lid (6) is made through one or more layers of micro-perforated material to allow the passage of hot water under pressure into the cartridge (1).

9. A cartridge (1) according to claim 1, characterized in that said lid (6) seals the container (2) and is perforated for the beverage delivery.

10. A cartridge (1) according to claim 1, characterized in that said container (2) is made by injection moulding of plastic material, such as polypropylene and the like.

11. A cartridge (1) according to claim 2, characterized in that said less thick portion (22) is substantially circular in shape.

* * * * *